US005518141A

United States Patent [19]

Newhouse et al.

[11] Patent Number: 5,518,141

[45] Date of Patent: May 21, 1996

[54] PRESSURE VESSEL WITH SYSTEM TO PREVENT LINER SEPARATION

[76] Inventors: Norman L. Newhouse; Alvin R. Cederberg, both of c/o Brunswick Corporation, 4300 Industrial Ave., Lincoln, Nebr. 68504

[21] Appl. No.: 186,443

[22] Filed: Jan. 24, 1994

[51] Int. Cl.[6] ..... F17C 1/06

[52] U.S. Cl. ..... 220/586; 220/590

[58] Field of Search ..... 220/586, 590

[56] References Cited

U.S. PATENT DOCUMENTS

| | | | |
|---|---|---|---|
| 4,491,247 | 1/1985 | Nitchman et al. | 220/586 |
| 4,690,295 | 9/1987 | Wills | 220/590 |
| 5,253,778 | 10/1993 | Sirosh . | |

FOREIGN PATENT DOCUMENTS 2193953 2/1974 France .

*Primary Examiner*—Joseph M. Moy
*Attorney, Agent, or Firm*—John R. Hoffman

[57] ABSTRACT

A pressure vessel is disclosed for holding fluids. The vessel includes a generally cylindrical outer shell fabricated of a substantially rigid, mechanically strong material, and having a generally hemispherical end section with an opening therein. An inner, generally fluid impervious flexible liner is disposed in the outer shell against the inside surface thereof. The liner has a generally hemispherical end section with an opening aligned with the opening in the outer shell. A boss has a neck portion for fitting in the opening in the outer shell. A generally hemispherical extension projects radially outwardly of the boss substantially entirely to the cylindrical configuration of the outer shell against the inside surface of the inner liner to prevent the generally hemispherical end section of the liner from pulling away from the outer shell.

13 Claims, 3 Drawing Sheets

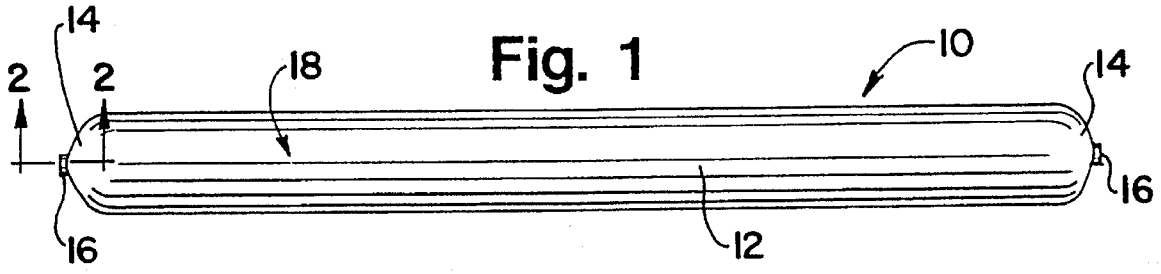
Fig. 1
Fig. 2 PRIOR ART
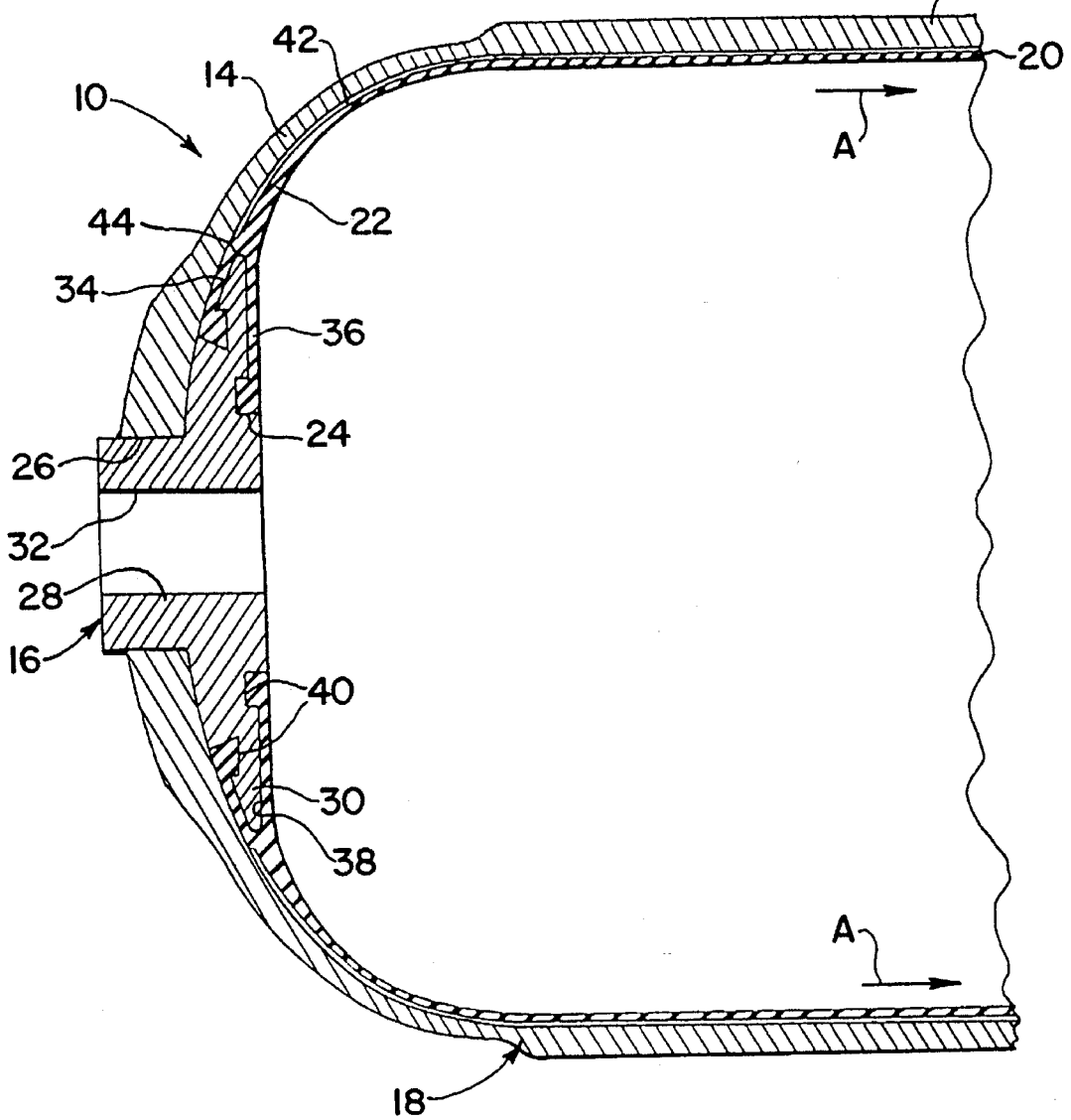

PRESSURE VESSEL WITH SYSTEM TO PREVENT LINER SEPARATION

FIELD OF THE INVENTION

This invention generally relates to the art of pressure vessels and, particularly, to a system for preventing separation of liners in such vessels.

BACKGROUND OF THE INVENTION

In many applications, the qualities of lightweight construction and high resistance to fragmentation and corrosion damage are highly desirable characteristics for a pressure vessel. These design criteria have been met for many years by the development of high pressure composite (fiber reinforced resin matrix) containers; for instance, container shells fabricated of laminated layers of wound fiberglass filaments or various types of other synthetic filaments which are bonded together by a thermal-setting or thermoplastic resin. An elastomeric or other non-metal resilient liner or bladder often is disposed within the composite shell to seal the vessel and prevent internal fluids from contacting the composite material.

Such composite vessels have become commonly used for containing a variety of fluids under pressure, such as storing helium, natural gas, nitrogen, rocket or other fuel, propane, etc. The composite construction of the vessels provides numerous advantages such as lightness in weight and resistance to corrosion, fatigue and catastrophic failure. These attributes are due to the high specific strengths of the reinforcing fibers or filaments which typically are oriented in the direction of the principal forces in the construction of the pressure vessels.

Filament wound vessels often are constructed in a spherical shape or an elongated cylindrical shape with generally hemispherical or hemispheroidal ends for use in high pressure applications. At least one of the ends has an opening, and a boss is positioned in the opening, with the boss reliably joining the inner liner with the outer composite shell such that fluid is prevented from penetrating between the liner and the shell. In many applications, such as in the aerospace industry, composite pressure vessels may be required to contain extremely high pressures, operating at 25,000 p.s.i. with design burst values in the range of 50,000 p.s.i. Consequently, as internal pressure increases, the interface of the boss, the liner and the outer shell is subjected to extreme structural loading.

Examples of pressure vessels of the character described above, including boss-liner attachment systems, are shown in copending application Ser. No. 902,725, dated Jun. 23, 1992 and assigned to the assignee of the present invention; as well as in U.S. Pat. No. 5,253,779 to Sirosh, dated Oct. 19, 1993. While both of these items of prior art may be successful for their intended purposes of compensating for varying stress generated between the boss and the composite shell of a pressure vessel, shearing stress between the boss and the inner liner, and steep strain gradients through the shell, problems still are encountered in these types of pressure vessels, particularly when the vessels are considerably elongated between their ends.

More particularly, an elongated pressure vessel generally includes a cylindrical side wall configuration including the outer composite shell and the inner liner, with at least one end being generally hemispherical (or hemispheroidal) in configuration. Such a vessel may be as long as 300 inches, such as on a semi-trailer truck for carrying natural gas, or other appropriate applications. The design specifications for such a vessel include accommodating temperatures as low as −40° F. When the pressure vessel cools to such temperatures, the inner liner tends to shrink, but the outer composite shell does not shrink as much. This difference between the coefficient of thermal contraction/expansion between the inner liner and the outer shell often causes the liner to separate from the boss and to separate and develop gaps between the liner and the shell at the hemispherical ends of the vessel. In fact, in a vessel which is 100 inches long and which is subjected to a temperature of −40° F., the inner liner may shrink a full one inch more than the outer shell. The shrinkage in the cylindrical areas of the liner literally pulls on the hemispherical ends of the liner. This invention is directed to solving those problems and preventing separation of the liner in the ends of an elongated pressure vessel.

SUMMARY OF THE INVENTION

An object, therefore, of the invention is to provide a new and improved system for preventing separation of an inner liner in a pressure vessel, particularly at the ends of an elongated vessel.

In the exemplary embodiment of the invention, a pressure vessel for holding fluids is disclosed and includes a generally cylindrical outer shell fabricated of a substantially rigid, mechanically strong material, and having a generally hemispherical (or hemispheroidal) end section with an opening therein. An inner, generally fluid impervious flexible liner is disposed in the outer shell against the inside surface thereof. The inner liner has a generally hemispherical (or hemispheroidal) end section with an opening aligned with the opening in the outer shell. Boss means are provided with a neck portion for fitting in the opening in the outer shell. The invention contemplates that the boss means include generally hemispherical extension means extending radially outwardly substantially entirely to the cylindrical configuration of the outer shell against the inside surface of the inner liner to prevent the generally hemispherical end section of the liner from pulling away from the outer shell.

The outer shell may be fabricated of filament wound composite material. The inner liner may be fabricated of plastic or other elastomeric material.

In one embodiment of the invention, the extension means of the boss means is provided by an integral flange portion of the boss means. In another embodiment of the invention, the extension means is provided by a separate flange secured to an inner end of the neck portion of the boss means.

The boss means are disclosed herein as including a flange portion extending outwardly from the neck portion, and the inner liner includes a dual-layer lip circumscribing the opening in the liner. An outer lip segment and an inner lip segment define an annular recess therebetween for receiving the flange portion of the boss means. In the one embodiment of the invention, the extension means is defined by this flange portion which is received in the annular recess of the dual-layer lip of the inner liner.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a side elevational view of a typical elongated pressure vessel with which the invention is applicable;

FIG. 2 is a fragmented axial section through one end of a pressure vessel according to the prior art;

DETAILED DESCRIPTION OF THE PREFERRED EMBODIMENT

Figure 3:
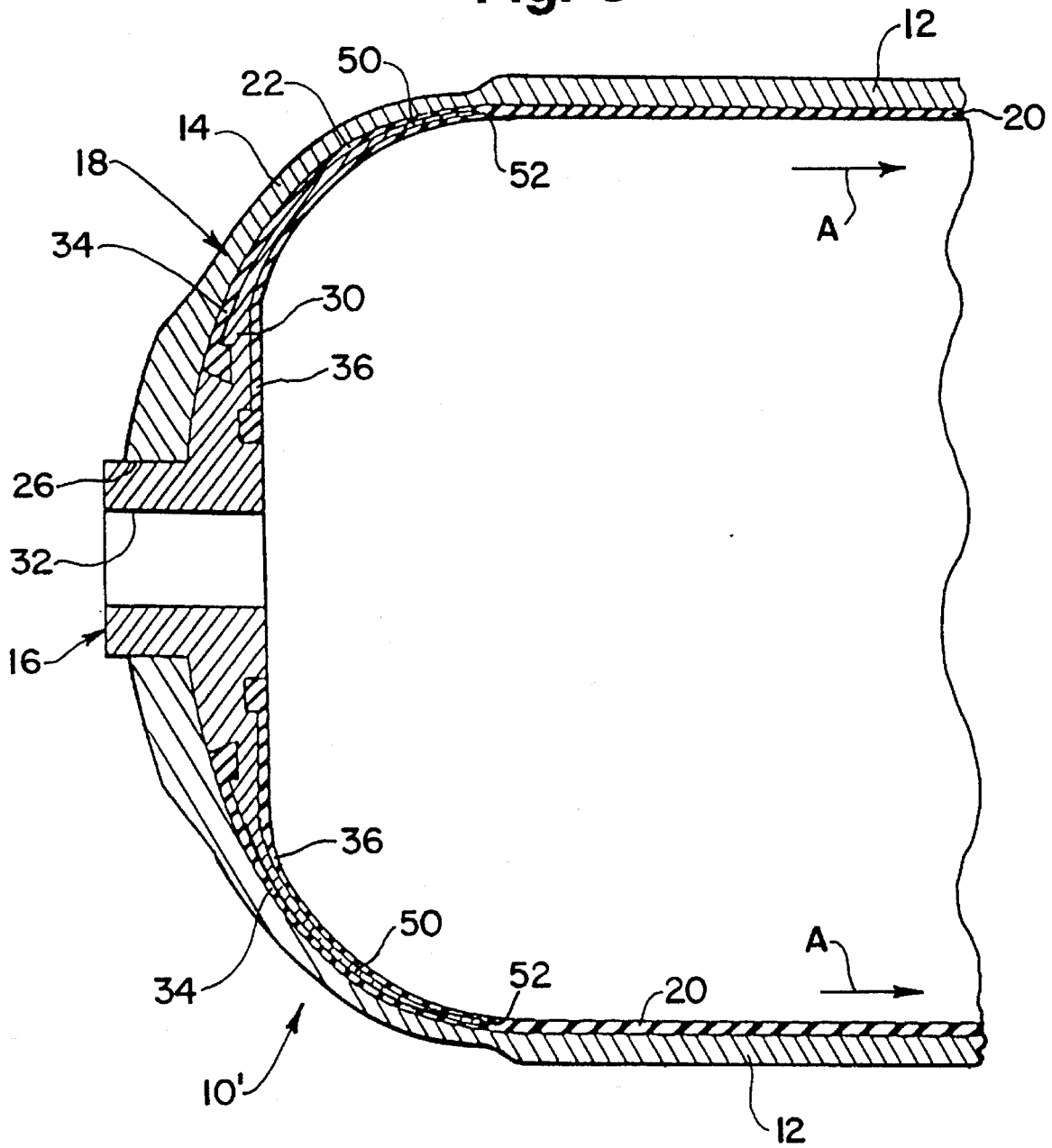
FIG. 3 is a view similar to that of FIG. 2, but illustrating one embodiment of the invention.

Referring to the drawings in greater detail, FIG. 1 shows a typical pressure vessel, generally designated 10, for holding fluids or the like. The vessel is considerably elongated and includes a main body section 12 of a generally cylindrical configuration and a pair of end sections 14 of generally hemispherical (or hemispheroidal) configurations. Bosses, generally designated 16, may be provided at one or both ends of the vessel to provide one or two ports communicating with the interior of the vessel. The exterior of the vessel is formed by an outer composite shell, generally designated 18. By "composite" is meant a fiber reinforced resin matrix material, such as a filament wound or laminated structure.

FIG. 2 shows an axial section through one hemispherical (or hemispheroidal) end 14 of a pressure vessel according to the prior art, such as if taken generally along line 2—2 of FIG. 1. For instance, the pressure vessel and boss structure shown in FIG. 2 corresponds to that illustrated in copending application Ser. No. 902,725, referred to in the "Background", above. It can be seen that the pressure vessel in FIG. 2 includes outer shell 18 and boss 16, as well as an inner liner 20 having a generally hemispherical (or hemispheroidal) end section 22 with an opening 24 aligned with an opening 26 in outer shell 18. Boss 16 is positioned within the aligned openings and includes a neck portion 28 and a radially outwardly projecting flange portion 30. The boss defines a port 32 through which fluid at high pressure may be communicated with the interior of pressure vessel 10. Inner liner 20 includes a dual-layer lip circumscribing opening 24 in the liner, with an outer lip segment 34 and an inner lip segment 36 defining an annular recess 38 therebetween for receiving flange portion 30 of boss 16. Dovetailed interengaging locking means 40 are provided between flange portion 30 and outer and inner lip segments 34 and 36, respectively, to lock inner liner 20 to boss 16.

As stated in the "Background", above, one of the problems with elongated pressure vessels, such as vessel 10 shown in FIG. 1, resides in the different coefficients of thermal expansion/contraction between inner liner 20 and outer shell 18. The inner liner shrinks considerably more than the outer shell when subjected to low temperatures. Consequently, with the long cylindrical configuration of the inner liner, the liner tends to "pull" in the direction of arrow "A" (FIGS. 2–4) creating separation forces on the hemispherical end section 22 of the liner, i.e. forces which tend to separate the hemispherical end section from the hemispherical end 14 of outer shell 18. It can be seen in FIG. 2 that a gap 42 is shown between hemispherical end section 22 of the liner and hemispherical end 14 of the shell to indicate that a separation has been created by the linear pulling forces "A" along the elongated cylindrical configuration of the vessel. If sufficient forces are created, the liner may even tend to separate from boss 16 at the rim of the flange portion 30 thereof, as indicated at 44.

As also stated in the "Background", above, pressure vessel 10 could be 300 inches long, or longer, such as a container tube on a semi-trailer truck. That long vessel may be as small as 13–33 inches in diameter, which would form a rather acute curvature in the hemispherical ends of the vessel. In addition, it has been found that a plastic or other elastomeric liner may shrink as much as one inch for each 100 inches of vessel length when exposed to temperatures on the order of −40° F. In a 300 inch vessel, this stretching of the liner would calculate to approximately three full inches, versus negligible expansion of composite shell 18. The present invention is directed to solving these problems and preventing the liner from separating from the shell and/or the boss in the end areas of the vessel.

More particularly, one embodiment of the invention is shown in a pressure vessel 10' in FIG. 3. Like reference numerals have been applied in FIG. 3 to represent like components as described above in relation to the prior art vessel of FIG. 2. Again, outer shell 18 is a composite shell fabricated of a substantially rigid, mechanically strong material such as fiber reinforcing material in a resin matrix. The fiber may be fiberglass, aramid, carbon, graphite, or any other generally known fibrous reinforcing material. The resin matrix may be epoxy, polyester, vinylester, thermoplastic or any other suitable resinous material capable of providing the properties required for the particular application in which the vessel is to be used.

Inner liner 20 is a generally fluid impervious flexible liner disposed in outer shell 18 against the inside surface thereof. The inner liner may be made of plastic or other elastomers and can be manufactured by compression molding, blow molding, injection molding or any other generally known technique. Boss 16 may be composed of an alloy of aluminum, steel, nickel or titanium, although it is understood that other metal and non-metal materials, such as composite materials, are suitable.

Again, pressure vessel 10' in FIG. 3 has a configuration wherein boss 16 has the radially outwardly projecting flange portion 30 sandwiched between the outer lip segment 34 and the inner lip segment 36 of the dual-layer lip configuration of the liner in the hemispherical end section 22 of the liner.

However, the invention contemplates that boss 16, and particularly flange portion 30 of the boss, include a generally hemispherical (or hemispheroidal) extension means 50 extending radially outwardly substantially entirely to the cylindrical configuration 12 of outer shell 18, i.e. the cylindrical configuration of the pressure vessel. In FIG. 3, extension means 50 extends all the way to a point 52 which is generally on line with the linear configuration of a section or plane through the cylindrical portion of the vessel. In the illustrated embodiment, extension means 50 is formed by an extension of integral flange portion 30 of boss 16. Accordingly, the hemispherical (or hemispheroidal) extension means 50 extends radially outwardly to a point adjacent the place where the hemispherical (or hemispheroidal) end section 50 joins with the cylindrical configuration 12 of outer shell 18.

With the invention as described above in relation to FIG. 3, it can be understood that when pulling (e.g. shrinkage) forces are created on liner 20 in the direction of arrow "A", the portion of the liner in the hemispherical end section 22 thereof, which is disposed against the inside surface of the hemispherical end 14 of outer shell 18, is supported against the outer shell by extension 50 of flange portion 30. Therefore, the liner, which comprises outer lip segment 34, cannot be pulled or separated away from the hemispherical end of the outer shell.

Figure 4:
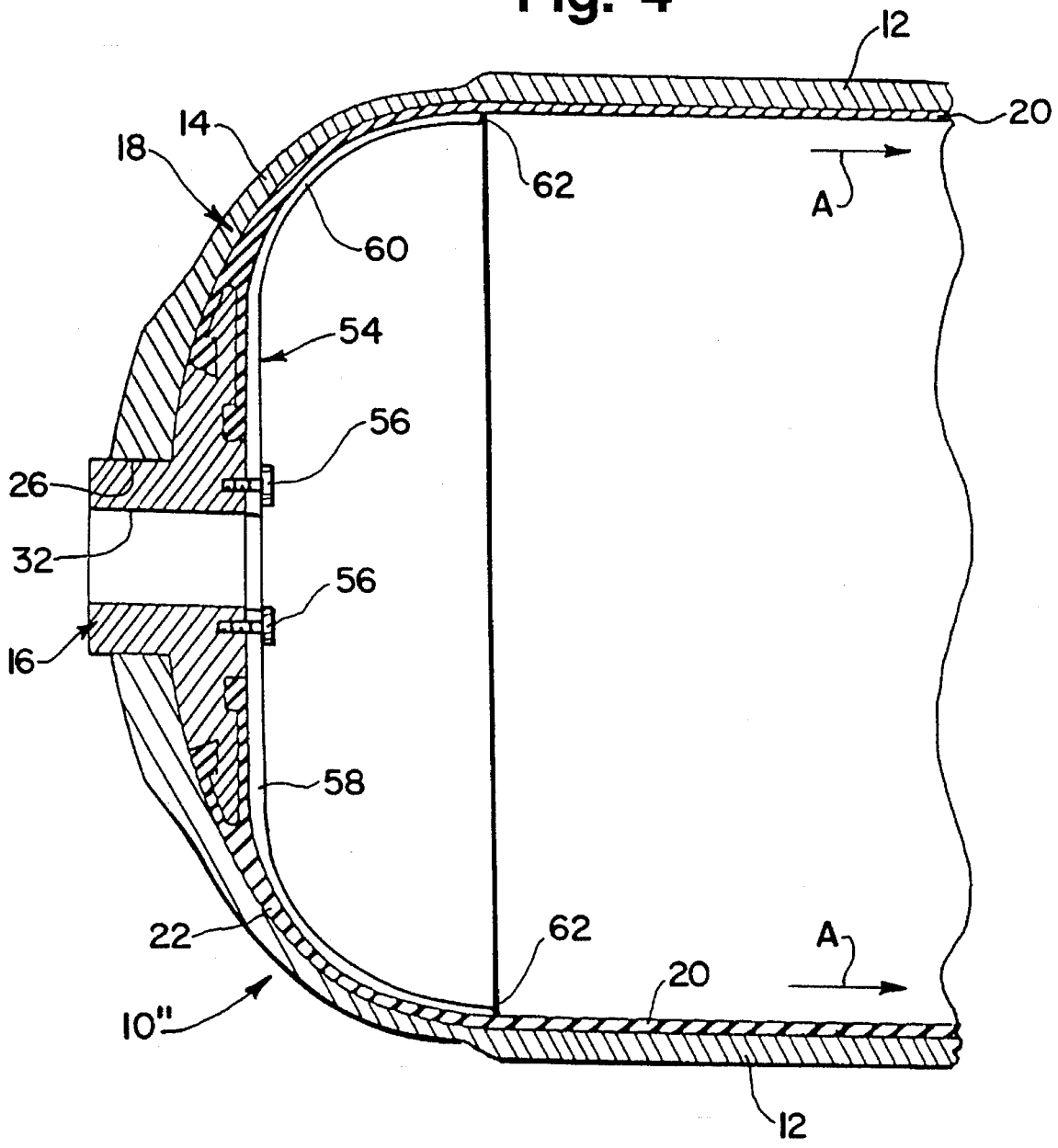
FIG. 4 is a view similar to that of FIG. 3, but illustrating a second embodiment of the invention.

FIG. 4 shows an alternate embodiment of the invention, and, again, like reference numerals have been applied in FIG. 4 corresponding to like components described above in relation to FIGS. 1–3. In FIG. 4, the pressure vessel is indicated as vessel 10".

In the embodiment of FIG. 4, the extension means which extends radially outwardly from boss 16 is provided by a separate hemispherical flange, generally designated 54 secured to boss 16 by fastening means in the form of bolts 56. Actually, flange 54 is generally hemispheroidal and includes a flattened section 58 surrounding port 32 in the boss, and a dome section 60 which, like extension means 50 in the embodiment of FIG. 3, extends to a point 62 substantially in line with the cylindrical configuration of the vessel. Separate flange 54 in FIG. 4 operates the same as extension means 50 of flange portion 30 of boss 16 in FIG. 3. In other words, flange 54, particularly the dome section 60 thereof, holds hemispherical end section 22 of liner 20 against hemispherical end 14 of shell 18 and resists separation of the liner from the shell and/or from the boss in response to forces indicated by arrow "A".

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A pressure vessel for holding fluids, comprising:

a generally cylindrical outer shell fabricated of a substantially rigid, mechanically strong material, and having a generally hemispherical end section with a opening therein;

an inner, generally fluid impervious elastomeric/plastic liner disposed in the outer shell against the inside surface thereof, and having a generally hemispherical end section with an opening aligned with the opening in the outer shell; and boss means having a neck portion for fitting in the opening in the outer shell, and having generally hemispherical extension means extending radially outwardly to a point adjacent the place where said hemispherical end section loins with said cylindrical outer shell and against the inside surface of at least a portion of the inner liner to prevent the generally hemispherical end section of the liner from pulling away from the outer shell.

2. The pressure vessel of claim 1 wherein said extension means comprises an integral flange portion of the boss means.

3. The pressure vessel of claim 1 wherein said extension means comprises a separate flange secured to said neck portion of the boss means.

4. The pressure vessel of claim 1 wherein said boss means include a flange portion extending outwardly from the neck portion, and the inner liner includes a dual-layer lip circumscribing the opening in the liner with an outer lip segment and an inner lip segment defining an annular recess therebetween for receiving the flange portion of the boss means.

5. The pressure vessel of claim 4 wherein said flange portion is integral with the boss means and defines said extension means.

6. The pressure vessel of claim 4 wherein said extension means extends from the neck portion of the boss means against the inner lip segment of the dual layer lip.

7. The pressure vessel of claim 6 wherein said extension means comprises a separate member secured to an inner end of the neck portion of the boss means.

8. The pressure vessel of claim 1 wherein said outer shell is fabricated of filament wound composite material.

9. The pressure vessel of claim 1 wherein said inner liner is fabricated of elastomeric material.

10. A pressure vessel for holding fluids, comprising:

a generally cylindrical outer shell fabricated of filament wound composite material and having a generally hemispherical end section with an opening therein;

an inner, generally fluid impervious elastomeric/plastic liner disposed in the outer shell against the inside surface thereof, and having a generally hemispherical end section with an opening aligned with the opening in the outer shell; and boss means having a neck portion for fitting in the opening in the outer shell, and having a generally hemispherical flange portion integral with the neck portion and extending radially outwardly to a point adjacent the place where said hemispherical end section loins with said cylindrical outer shell and against the inside surface of at least a portion of the inner liner to prevent the generally hemispherical end section of the liner from pulling away from the outer shell.

11. The pressure vessel of claim 10 wherein said inner liner includes a dual-layer lip defining an outer lip segment and an inner lip segment defining an annular recess therebetween for receiving the radially extending flange portion of the boss means.

12. A pressure vessel for holding fluids, comprising:

a generally cylindrical outer shell fabricated of filament wound composite material and having a generally hemispherical end section with an opening therein;

an inner, generally fluid impervious elastomeric/plastic liner disposed in the outer shell against the inside surface thereof, and having a generally hemispherical end section with an opening aligned with the opening in the outer shell;

boss means having a neck portion for fitting in the opening in the outer shell; and a generally hemispheroidal flange secured to the boss means and extending radially outwardly therefrom to a point adjacent the place where said hemispherical end section joins with said cylindrical outer shell and against the inside surface of at least a portion of the inner liner to prevent the generally hemispherical end section of the liner from pulling away from the outer shell.

13. The pressure vessel of claim 12 wherein said boss means include a flange portion extending outwardly from the neck portion, and the inner liner includes a dual-layer lip circumscribing the opening in the liner with an outer lip segment and an inner lip segment defining an annular recess therebetween for receiving the flange portion of the boss means.

* * * * *